US011964180B1

(12) United States Patent
Li

(10) Patent No.: US 11,964,180 B1
(45) Date of Patent: Apr. 23, 2024

(54) HORIZONTAL FITNESS BAR APPARATUS

(71) Applicant: Zhifang Li, Ankang (CN)

(72) Inventor: Zhifang Li, Ankang (CN)

( * ) Notice: Subject to any disclaimer, the term of this patent is extended or adjusted under 35 U.S.C. 154(b) by 0 days.

(21) Appl. No.: 18/136,354

(22) Filed: Apr. 19, 2023

(51) Int. Cl.
*A63B 1/00* (2006.01)
*A63B 21/00* (2006.01)
*A63B 21/16* (2006.01)

(52) U.S. Cl.
CPC ..... *A63B 1/00* (2013.01); *A63B 21/1636* (2013.01); *A63B 21/4035* (2015.10)

(58) Field of Classification Search
CPC ... A63B 1/00; A63B 21/1636; A63B 21/4035; A63B 21/1618–1663; A63B 23/1218; A63B 1/005; A63B 7/00; A63B 9/00; A63B 21/00047; A63B 21/00185; A63B 21/16–169; A63B 22/0002; A63B 23/12–1227
See application file for complete search history.

(56) References Cited

U.S. PATENT DOCUMENTS 4,844,448 A * 7/1989 Niznik ..... A63B 21/4047 482/40
5,417,628 A * 5/1995 Vanderbleek ..... A63B 21/1636 482/40
10,898,752 B1 * 1/2021 Kehoe ..... A63B 23/03525
2012/0046150 A1 * 2/2012 Stacey ..... A63B 23/0216 482/131
2012/0094808 A1 * 4/2012 Leier ..... A63B 23/1218 482/40
2012/0115684 A1 * 5/2012 Nguyen ..... A63B 21/1627 482/40
2013/0225373 A1 * 8/2013 Poat ..... A63B 23/1227 482/40
2014/0094347 A1 * 4/2014 Orakwusi ..... A63B 23/1218 482/38
2014/0221163 A1 * 8/2014 McBride ..... A63B 21/00047 482/40
2016/0166874 A1 * 6/2016 Sheeler ..... A63B 1/00 482/40
2021/0339075 A1 * 11/2021 Listro ..... A63B 21/1636

* cited by examiner

*Primary Examiner* — Joshua Lee
*Assistant Examiner* — Catrina A Letterman
(74) *Attorney, Agent, or Firm* — Jose Cherson Weissbrot

(57) ABSTRACT

A horizontal fitness bar apparatus includes a first handle bar extending laterally and a first connecting rod having a first through hole and a second connecting rod having a second through hole. The horizontal fitness bar apparatus also includes a lateral support rod associated with the first handle bar via the first connecting rod and the second connecting rod. A first pipe body is detachably coupled to the first through hole of the first connecting rod. A second pipe body is detachably coupled to the second through hole of the second connecting rod. The horizontal fitness bar apparatus also includes a first rod body, a second rod, first locking components and second locking components. The horizontal fitness bar apparatus also includes second handlebars extending transversely with respect to the first handle bar.

7 Claims, 4 Drawing Sheets

HORIZONTAL FITNESS BAR APPARATUS

FIELD OF DISCLOSURE

The present disclosure relates to fitness apparatus. More specifically, relates to a horizontal fitness bar apparatus mounted to an external frame structure.

BACKGROUND OF THE DISCLOSURE

Each joint in the human body is stretched during physical activity, which causes people to frequently unfold their body's kinematics. For this reason, the horizontal bar workout machine is one of the most common and basic types of sports equipment.

The horizontal bar is a common piece of home fitness equipment because it takes up little space and makes exercising easy. According to the installation technique, it can be separated into floor horizontal bars and door horizontal bars, and door horizontal bars may be further split into hanging door horizontal bars and lateral supported horizontal bars.

The existing application number "CN201620570758.3" discloses a horizontal bar device fixed on the door frame, which is a hanging door horizontal bar, including a cross bar, a connecting rod, a hook welding assembly, a push rod welding The cylindrical pin and the horizontal bar apparatus are movably installed above the door frame through a cross bar and a hook. On both sides of the cross bar, one end of the connecting rod is fixedly connected with the lower rod, the other end of the connecting rod is connected with the ejector rod through the ejector rod welding assembly and the compression spring, the hook welding assembly is sleeved on the connecting rod, and the hook welding assembly is provided with a fixed hook. The present disclosure has the advantages of reasonable structure and convenient use and installation.

Conventional fitness apparatus are not accommodating, and in actual use, the actual size of a doorframe is different. Further, existing fitness apparatus mounted on a door is non-adjustable and cannot adapt to the doorframes of various sizes.

Accordingly, there exists a need for a horizontal fitness bar apparatus that addresses the shortcomings and issues of the prior art.

SUMMARY OF THE DISCLOSURE

In order to overcome above-mentioned technical disadvantages and existing problems of prior arts, the purpose of the present disclosure is to provide a horizontal fitness bar apparatus.

In light of the above, in one aspect of the present disclosure, a horizontal fitness bar apparatus is disclosed herein. The horizontal fitness bar apparatus includes a first handle bar extending laterally, a first connecting rod having a first through hole, a second connecting rod having a second through hole, and a lateral support rod attached against the external frame structure. The first through hole extends from a top surface to a bottom surface of the first connecting rod. The second through hole extends from a top surface to a bottom surface of the second connecting rod. The lateral support rod may be associated with the first handle bar via the first connecting rod and the second connecting rod. The lateral support rod that is configured to be adjusted to a predetermined distance according to the size of the external frame structure. The horizontal fitness bar apparatus also includes a first pipe body, a second pipe body, a first rod body, a second rod body, first locking components, second locking components, and second handle bars. The first pipe body is detachably coupled to the first through hole of the first connecting rod. The second pipe body is detachably coupled to the second through hole of the second connecting rod. The first rod body slidably coupled to the first pipe body and the second rod body slidably coupled to the second pipe body. The horizontal fitness bar apparatus includes the first locking components detachably coupled to the first pipe body and the second pipe body with the first connecting rod and the second connecting rod respectively. The horizontal fitness bar apparatus includes the second locking components slidably coupling the first rod body and the second rod body with the first pipe body and the second pipe body respectively. The horizontal fitness bar apparatus includes second handlebars extending transversely with respect to the first handle bar. Each of the second handle bars are coupled with the first rod body and the second rod body.

These elements, together with the other aspects of the present disclosure and various features are pointed out with particularity in the claims annexed hereto and form a part of the present disclosure. For a better understanding of the present disclosure, its operating advantages, and the specified object attained by its uses, reference should be made to the accompanying drawings and descriptive matter in which there are illustrated exemplary embodiments of the present disclosure.

BRIEF DESCRIPTION OF THE DRAWINGS

The advantages and features of the present disclosure will become better understood with reference to the following detailed description taken in conjunction with the accompanying drawing, in which.

Like reference, numerals refer to like parts throughout the description of several views of the drawing.

DETAILED DESCRIPTION OF THE DISCLOSURE

The following is a detailed description of embodiments of the disclosure depicted in the accompanying drawings. The embodiments are in such detail as to communicate the disclosure. However, the amount of detail offered is not intended to limit the anticipated variations of embodiments; on the contrary, the intention is to cover all modifications, equivalents, and alternatives falling within the spirit and scope of the present disclosure.

In the following description, numerous specific details are set forth in order to provide a thorough understanding of the embodiments of the present disclosure. It may be apparent to one skilled in the art that embodiments of the present disclosure may be practiced without some of these specific details.

Various terms as used herein are shown below. To the extent a term is used, it should be given the broadest definition persons in the pertinent art have given that term as reflected in printed publications and issued patents at the time of filing.

The terms "a" and "an" herein do not denote a limitation of quantity, but rather denote the presence of at least one of the referenced items.

The terms "having", "comprising", "including", and variations thereof signify the presence of a component.

Figure 1:
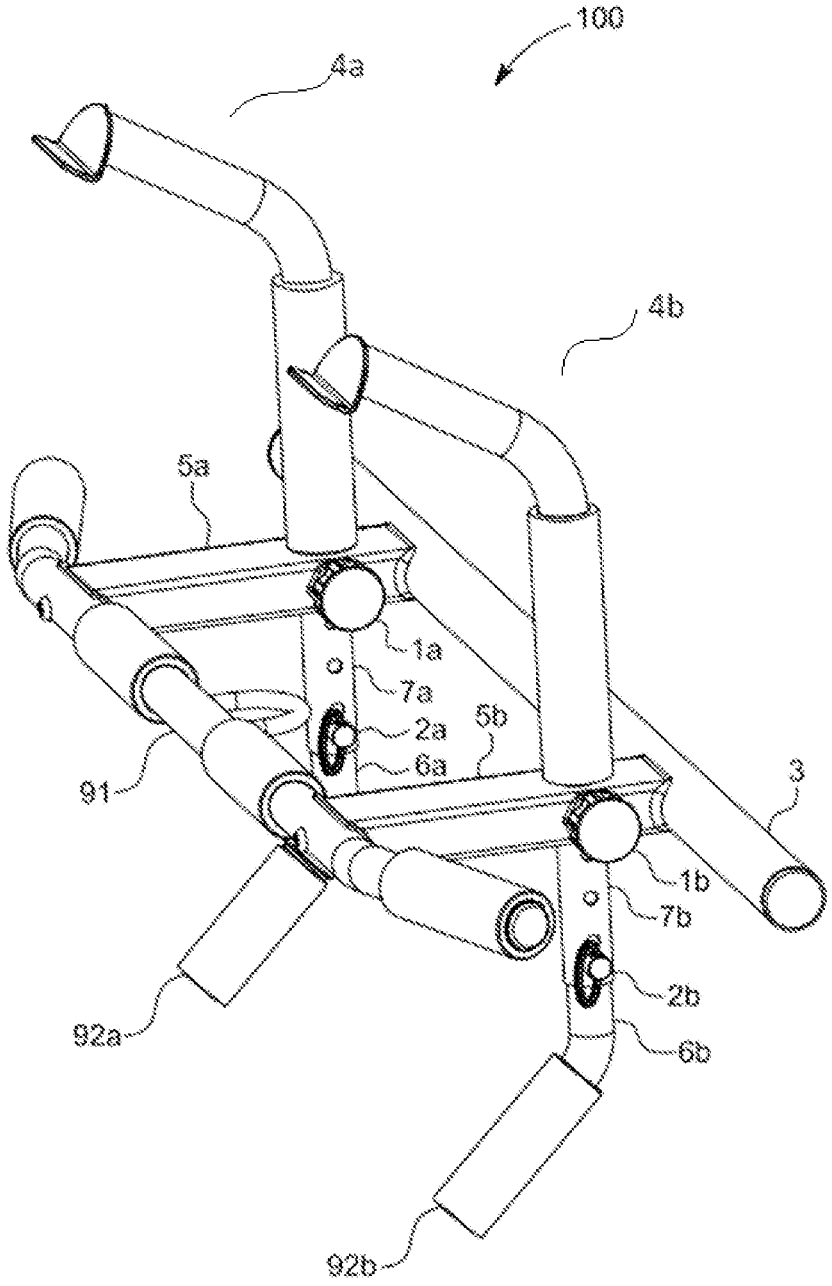
FIG. 1 illustrates a schematic view of a horizontal fitness bar apparatus, in accordance with an exemplary embodiment of the present disclosure.

Referring now to FIG. 1 to FIG. 4 to describe various exemplary embodiments of the present disclosure. FIG. 1 illustrates a schematic view of a horizontal fitness bar apparatus (100), in accordance with an exemplary embodiment of the present disclosure. The horizontal fitness bar apparatus (100) for being mounted to an external frame structure (8). The horizontal fitness bar apparatus (100) includes a first handle bar (91), a first connecting rod (5*a*), a second connecting rod (5*b*), a lateral support rod (3), a first pipe body (7*a*), a second pipe body (7*b*), a first rod body (6*a*), a second rod body (6*b*), first locking components (1*a*, 1*b*), second locking components (2*a*, 2*b*), second handle bars (92*a*, 92*b*), a plurality of hooks (4*a*, 4*b*), a plurality of first bracket components (16*a*, 16*b*, 16*c*, 16*d*) defined along the distal ends of the first connecting rod (5*a*), a second connecting rod (5*b*), and a plurality of second bracket components (18*a*, 18*b*) defined at one end of the plurality of hooks (4*a*, 4*b*).

The horizontal fitness bar apparatus (100) includes the first handle bar (91) extending laterally. A user may grasp the first handle bar (91) to exercise. If the horizontal fitness bar apparatus (100) may be installed on the external frame structure (8) (hereinafter may also be referred to as the doorframe), the user may grasp from the first handle bar (91), which is convenient for the user to do exercises such as pull-ups. The first handle bar (91) may include a loop (26) for hanging a plurality of objects like rope, cables, and so forth.

The first connecting rod (5*a*) includes a first through hole (51*a*) and a second connecting rod (5*b*) includes a second through hole (51*b*). The first through hole (51*a*) may extend from a top surface (20*a*) to a bottom surface (22*a*) of the first connecting rod (5*a*). Further, the second through hole (51*b*) may extend from a top surface (20*b*) to a bottom surface (22*b*) of the second connecting rod (5*b*). The first through hole (51*a*) and the second through hole (51*b*) may be formed at a pre-set distance.

Figure 2:
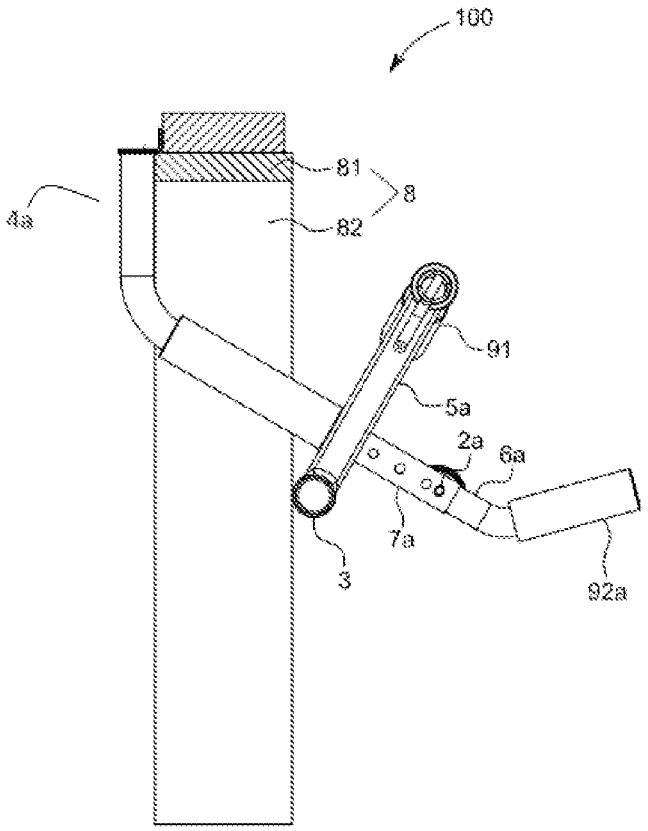
FIG. 2 illustrates a side view of the horizontal fitness bar apparatus installed on a doorframe, in accordance with an exemplary embodiment of the present disclosure.

It should be noted that, as shown in FIG. 1, the overall structure of the doorframe (8) is an inverted "U" shape. Further, the external frame structure (8) include a top beam (81) and a pair of side beams (82). The top beam (81) is horizontal, and the side beams (82) are vertical, as seen in FIG. 2.

The lateral support rod (3) may be attached against the external frame structure (8). The lateral support rod (3) may be associated with the first handle bar (91) via the first connecting rod (5*a*) and the second connecting rod (5*b*).

The lateral support rod (3) may be attached against the side surfaces of the pair of side beams (82) of the frame (8). Moreover, the top beam (81) may be disposed between the pair of side beams (82). The lateral support rod (3) may configured to be adjusted to a predetermined distance according to the size of the external frame structure (8).

Figure 3:
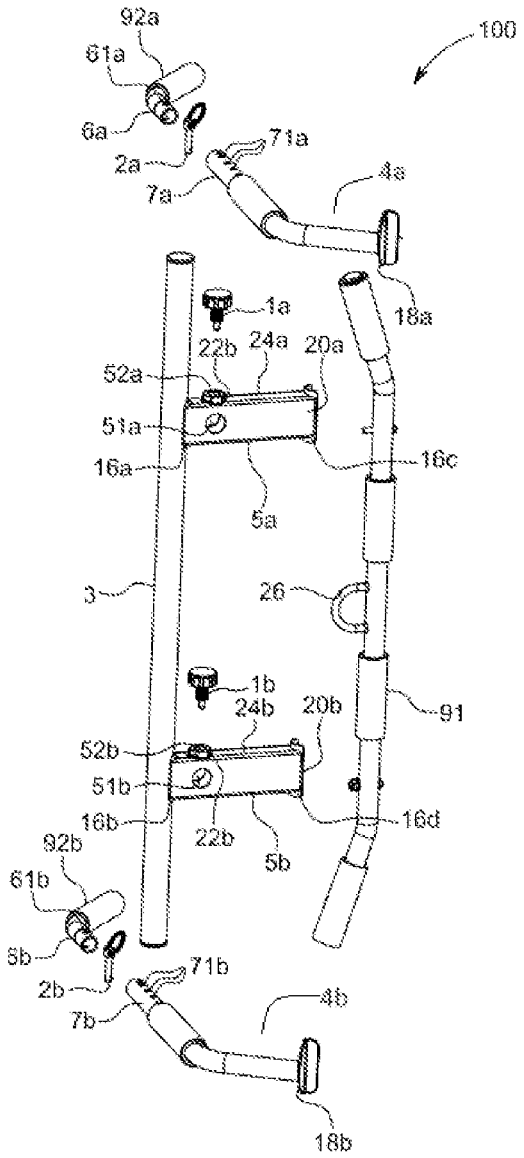
FIG. 3 illustrates an exploded view of the horizontal fitness bar apparatus, in accordance with an exemplary embodiment of the present disclosure.

The lateral support rod (3) may be close to or away from the plurality of hooks (4*a*, 4*b*), and the distance between the lateral support rod (3) and the plurality of hooks (4*a*, 4*b*) may be adjusted. If the distance between the lateral support rod (3) and the plurality of hooks (4*a*, 4*b*) is adjusted to a predetermined distance, the first locking components (1*a*, 1*b*) may be detachably arranged on the first connecting rod (5*a*) and the second connecting rod (5*b*) to be locked so that the lateral support rod (3) and the plurality of hooks (4*a*, 4*b*) may be kept at the predetermined distance, as seen in FIG. 3. In one embodiment, the predetermined distance is determined according to the size of the actual external frame structure (8).

The first handle bar (91), the lateral support rod (3), the first connecting rod (5*a*) and the second connecting rod (5*b*) form a rectangular area. The structure of the rectangular area plays the role of four-point support, which improves the structural strength of the first handle bar (91), the lateral support rod (3), the first connecting rod (5*a*) and the second connecting rod (5*b*).

In an exemplary embodiment, the user may adjust the lateral support rod (3) and the plurality of hooks (4*a*, 4*b*) to the predetermined distance according to the size of the external frame structure (8), so that the horizontal fitness bar apparatus (100) may be better adapted to the external frame structure (8) of different sizes. In addition, only the first locking component (1*a*, 1*b*) needs to be disassembled to realize the locking and unlocking of the first connecting rod (5*a*) and the second connecting rod (5*b*) to the plurality of hooks (4*a*, 4*b*). Therefore, the horizontal fitness bar apparatus (100) on the door has the advantages of wide application range, one-key adjustment and stable support.

The horizontal fitness bar apparatus (100) further includes the first pipe body (7*a*) detachably coupled to the first through hole (Ma) of the first connecting rod (5*a*). The horizontal fitness bar apparatus (100) further includes the second pipe body (7*b*) detachably coupled to the second through hole (Mb) of the second connecting rod (5*b*). In addition, the plurality of hooks (4*a*, 4*b*) may be associated with the first pipe body (7*a*) and the second pipe body (7*b*) for hanging the horizontal fitness bar apparatus (100) on the top beam (81) of the external frame structure (8). According to embodiments of the present invention, the plurality of hooks (4*a*, 4*b*) includes a cross-section of 1' shape.

An angle between the top beam (81) and a wall is almost a right angle. If the plurality of hooks (4*a*, 4*b*) is hung on the top beam (81), each of the plurality of hooks (4*a*, 4*b*) can be adapted to the angle between the top beam (81) and the wall, which improves the assembly firmness of the plurality of hooks (4*a*, 4*b*) and the top beam (81).

The first rod body (6*a*) may be slidably coupled to the first pipe body (7*a*). The second rod (6*b*) may be slidably coupled to the second pipe body (7*b*).

The first locking components (1*a*, 1*b*) detachably coupling the first pipe body (7*a*) and the second pipe body (7*b*) with the first connecting rod (5*a*) and the second connecting rod (5*b*) respectively. The second locking components (2*a*, 2*b*) slidably coupling the first rod body (6*a*) and the second rod body (6*b*) with the first pipe body (7*a*) and the second pipe body (7*b*) respectively.

In one embodiment, the first connecting rod (5*a*) and the second connecting rod (5*b*) may be fixedly arranged between the first handle bar (91) and the lateral support rod (3) to provide an enclosed rectangular area.

Figure 4:
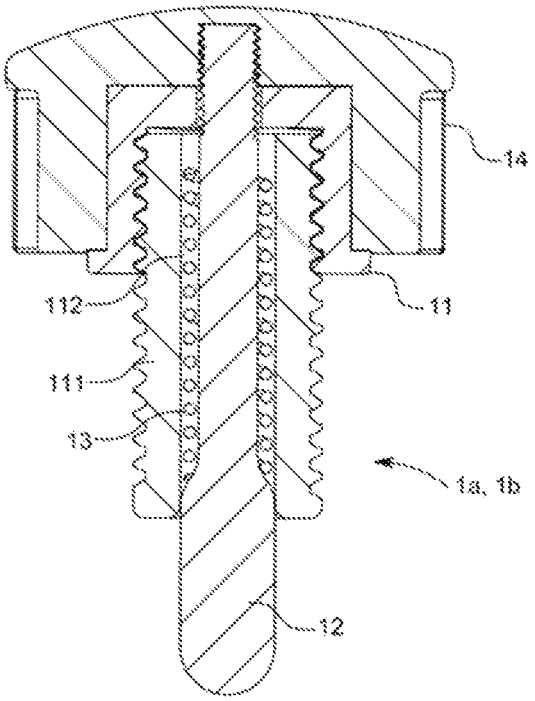
FIG. 4 illustrates a schematic cross-sectional structure diagram of a first locking component of the present invention, in accordance with an exemplary embodiment of the present disclosure.

Referring to FIG. 4, the first locking component (1*a*, 1*b*) may include a connector (11), a bolt (12) slidably arranged on the connector (11), an elastic member (13) arranged along the bolt (12), and a button (14) disposed over the connector (11). The elastic member (13) may force the bolt (12) to be inserted on the first connecting rod (5*a*) and the second connecting rod (5*b*).

In one embodiment, the connector (11) may include a screw section (111) having external threads to be screwed into first connecting holes and the second connecting holes (52*a*, 52*b*) associated with the first connecting rod (5*a*) and the second connecting rod (5*b*). The first connecting holes and the second connecting holes (52*a*, 52*b*) may be formed on side surfaces (24*a*, 24*b*) of the first connecting rod (5*a*) and the second connecting rod (5*b*). The first connecting hole (52*a*) and the second connecting hole (52*b*) may be a hole with an internal thread. If the screw section (111) rotates relative to the first connecting hole (52*a*) and the second connecting hole (52*b*), the screw section (111) may be tightened or unscrewed on the first connecting hole (52*a*) and the second connecting hole (52*b*), so the detachable structure between the connector (11) and the first connecting rod (5*a*) and the second connecting rod (5*b*) may be done by hand without using tools. It can be disassembled, which further facilitates the use of the first locking components (1*a*, 1*b*).

One of the first connecting holes and the second connecting holes (52*a*, 52*b*) may communicate with the first through hole (51*a*) and another with the second through hole (51*b*). Each of the first locking components (1*a*, 1*b*) may be screwed into each of the first connecting holes and the second connecting holes (52*a*, 52*b*). Each of the first connecting holes and the second connecting holes (52*a*, 52*b*) may be located at the side of the first connecting rod (5*a*) and the second connecting rod (5*b*).

The first handle bar (91) and the first connecting rod (5*a*) and the second connecting rod (5*b*) may be fixedly arranged together by the bolt connection. Further, the lateral support rod (3) and the first connecting rod (5*a*) and the second connecting rod (5*b*) may be fixedly arranged together by welding.

A plurality of second connecting holes (71*a*, 71*b*) may be opened on the plurality of hooks (4*a*, 4*b*), and the elastic member (13) forces the bolt (12) to be inserted into one of the second connecting hole (71*a*, 71*b*). The arrangement direction of the plurality of second connecting holes (71*a*, 71*b*) may be consistent with the free sliding direction of the plurality of hooks (4*a*, 4*b*) on the first connecting rod (5*a*) and the second connecting rod (5*b*).

There are at least two second connecting holes (71*a*, 71*b*), whereby the position of the plurality of hooks (4*a*, 4*b*) on the first connecting rod (5*a*) and the second connecting rod (5*b*) may be adjusted.

The arrangement direction of the plurality of second connection holes (71*a*, 71*b*) is consistent with the length direction the plurality of hooks (4*a*, 4*b*). Two or more second connection holes (71*a*, 71*b*) may be opened on the plurality of hooks (4*a*, 4*b*).

The connector (11) may be detachably arranged on the first connecting rod (5*a*) and the second connecting rod (5*b*), and the elastic member (13) forces the bolt (12) (hereinafter may also be referred to as the latch or plug pin) to be inserted in direction the plurality of hooks (4*a*, 4*b*). Further, the bolt (12) is equivalent to being detachably arranged on the first connecting rod (5*a*) and the second connecting rod (5*b*), so that the first connecting rod (5*a*) and the second connecting rod (5*b*), and the plurality of hooks (4*a*, 4*b*) to fasten thereto together. In one embodiment, the elastic member (13) forces the plug pin (12) to be inserted in the first connecting rod (5*a*) and the second connecting rod (5*b*).

In one implementation, if the user drives the latch (12) to disengage from in the first connecting rod (5*a*) and the second connecting rod (5*b*), the plurality of hooks (4*a*, 4*b*) may slide freely on the first connecting rod (5*a*) and the second connecting rod (5*b*). The user may unplug the bolt 12 from the first connecting rod (5*a*) and the second connecting rod (5*b*) with bare hands without using tools, which further facilitates the use of the at least two first locking components (1*a*, 1*b*).

As seen in FIG. 4, a sliding groove (112) may be defined on the connector (11). The bolt (12) may slide along the direction of the sliding groove (112), and the elastic member (13) is disposed in the sliding groove (112).

The elastic member (13) may be arranged in the sliding groove (112). Further, the connector (11) plays a role of protecting the elastic member (13) and preventing the elastic member (13) from being exposed outside.

The elastic member (13) may be a coil spring, and the elastic member (13) is sheathed on the bolt (12). The button (14) may be associated with the first locking components (1*a*, 1*b*) is fixedly arranged on the bolt (12). One end of the elastic member (13) abuts on the bolt (12), and the other end of the elastic member (13) abuts against an inner bottom of the sliding groove (112). The first locking components (1*a*, 1*b*) includes the button (14) fixedly arranged on the bolt (12). Further, the button (14) may be used for the user to grasp and use, to facilitate the user to exert force on the bolt (12) passing through the sliding groove (112).

The button (14) may be screwed to one end of the bolt (12), which simplifies the connection structure between the button (14) and the bolt (12).

The horizontal fitness bar apparatus (100) includes the second handle bars (92*a*, 92*b*) extending transversely with respect to the first handle bar (91). Each of the second handle bars (92*a*, 92*b*) are coupled with the first rod body (6*a*) and the second rod body (6*b*). In one embodiment, the second handle bars (92*a*, 92*b*) may be fixedly arranged on the plurality of hooks (4*a*, 4*b*).

The second handlebars (92*a*, 92*b*) may also be used for the user to grasp, which enriches the user's grasping posture on the horizontal fitness bar apparatus (100) on the door.

In actual use, the length direction of the first handle bar (91) may be substantially consistent with the length direction of the top beam (81), and the second handlebars (92*a*, 92*b*) and the top beam (81) are nearly perpendicular.

In actual use, if the second handle bars (92*a*, 92*b*) approaches or moves away from the plurality of hooks (4*a*, 4*b*), the distance between the two second handle bars (92*a*, 92*b*) and the external frame structure (8) increases or decreases, if the distance between the second handle bars (92*a*, 92*b*) and the external frame structure (8) is adjusted. When the desired distance is reached, each of the second locking components (2*a*, 2*b*) may be detachably arranged among the first rod body (6*a*), the second rod body (6*b*), the first pipe body (7*a*) and the second pipe body (7*b*), so that the second handle bars (92*a*, 92*b*) and the external frame structure (8) may be kept at a required distance, referring back to FIG. 3. The required distance may be determined based on the user's comfortable grip on the second handlebars (92*a*, 92*b*).

The user may adjust the distance between the second handlebars (92*a*, 92*b*) and the frame (8) according to the actual use, so that the user may comfortably hold the second handle bars (92*a*, 92*b*) for exercise.

One of the second handlebars (92*a*, 92*b*) and the first rod body (6*a*) and another of the second handle bars (92*a*, 92*b*) and the second rod body (6*b*) are integrally formed together. In one embodiment, the second handlebars (92*a*, 92*b*), the first rod body (6*a*), the second rod body (6*b*) may be made of a round tube. The plurality of hooks (4*a*, 4*b*) may be welded on the outer end of the first pipe body (7*a*) and the second pipe body (7*b*). The second pipe body (7*b*) passes through the second hole (51*b*) of the second connecting rod (5*b*), and the second connection holes (71*a*, 71*b*) are opened on a side of the second pipe body (7*b*). If the second rod body (6*b*) freely slides on the second pipe body (7*b*), it is consistent with the length direction of the second rod body (6*b*).

Further, the first rod body (6*a*) includes a plurality of pins (61*a*) and the second rod body (6*b*) includes a plurality of pinholes (61*b*). Each of the second locking component (2*a*, 2*b*) passes through one of the plurality of pin holes (61*a*, 61*b*) to lock the first pipe body (7*a*) to the first rod body (6*a*) and the second pipe body (7*b*) to the second rod body (6*a*) to adjust the height of the second handle bars (92*a*, 92*b*) as per a user requirement.

The second locking components (2*a*, 2*b*) passes through the plurality of pin holes (61*a*, 61*b*) means that the second locking components (2*a*, 2*b*) and the second rod body (6*b*) are plugged together, which improves the firmness of the connection between the second locking components (2*a*, 2*b*) and the second rod body (6*b*).

In one embodiment, the second locking components (2*a*, 2*b*) may be an elastic pin, and the second locking components (2*a*, 2*b*) may also passed through the plurality of second connecting holes (71*a*, 71*b*). The second locking components (2*a*, 2*b*) also passes through the plurality of second connecting holes (71*a*, 71*b*) means that the second locking components (2*a*, 2*b*) and the second pipe body (7*b*) are also plugged together, which improves the connection between the second locking components (2*a*, 2*b*) and the second rod body (6*b*). If the second locking components (2*a*, 2*b*) is passed through different second connecting holes (71*a*, 71*b*), the positioning position of the second rod body (6*b*) on the second pipe body (7*b*) can be adjusted.

The horizontal fitness bar apparatus (100) further includes the first connecting rod (5*a*) and the second connecting rod (5*b*) fixedly associated with the lateral support rod (3) and the first handle bar (91). The horizontal fitness bar apparatus (100) also includes the plurality of hooks (4*a*, 4*b*), which slide freely on first connecting rod (5*a*) and the second connecting rod (5*b*), when the first locking component (1*a*, 1*b*) is loosened.

In one embodiment, the lateral support rod (3) may be fixedly coupled to the first connecting rod (5*a*) and the second connecting rod (5*b*) through a welding process.

In one implementation, if the lateral support rod (3) approaches or moves away from the plurality of hooks (4*a*, 4*b*), the first handle bar (91) may approach or move away from the plurality of hooks (4*a*, 4*b*) synchronously, so that the first handle bar (91) can always be kept at an appropriate distance from the frame (8), which is convenient for use or grip.

In actual use, if the horizontal fitness bar apparatus (100) is installed on the doorframe (8), the plurality of hooks (4*a*, 4*b*) and the lateral support rod (3) are respectively arranged on both sides of the external frame structure (8). If the user does pull-ups on the horizontal fitness bar apparatus (100) installed on the door frame (8), the plurality of hooks (4*a*, 4*b*) keep hanging tightly on the top beam (81) under the action of gravity of the user, and the lateral support rod (3) remains tightly pressed against the side beam (82) under the action of gravity of the user, so that the horizontal fitness bar apparatus (100) on the door plays a good role for the user.

In the invention, the user can adjust the lateral support rod (3) and the plurality of hooks (4*a*, 4*b*) to the required distance according to the size of the actual frame (8), so that the horizontal fitness bar apparatus (100) on the door can be better adapted to the door frames of different sizes. In addition, it only needs to be disassembled the first locking components (1*a*, 1*b*) and the second locking components (2*a*, 2*b*) to realize the locking and unlocking of the plurality of hooks (4*a*, 4*b*) with the first connecting rod (5*a*) and the second connecting rod (5*b*), so the horizontal fitness bar apparatus (100) on the door has the advantages of wide application range, one-key adjustment and stable support.

The foregoing descriptions of specific embodiments of the present disclosure have been presented for purposes of illustration and description. They are not intended to be exhaustive or to limit the present disclosure to the precise forms disclosed, and many modifications and variations are possible in light of the above teaching. The embodiments were chosen and described to best explain the principles of the present disclosure and its practical application, and to thereby enable others skilled in the art to best utilize the present disclosure and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the scope of the present disclosure.

What is claimed is:

1. A horizontal fitness bar apparatus (100) configured to be mounted to an external frame structure (8), the horizontal fitness bar apparatus (100) comprising:

a first handle bar (91) extending laterally;

a first connecting rod (5*a*) having a first through hole (51*a*), wherein the first through hole (51*a*) extends from a top surface (20*a*) to a bottom surface (22*a*) of the first connecting rod (5*a*); and a second connecting rod (5*b*) having a second through hole (51*b*), wherein the second through hole (51*b*) extends from a top surface (20*b*) to a bottom surface (22*b*) of the second connecting rod (5*b*);

a lateral support rod (3) attached against the external frame structure (8), the lateral support rod (3) is detachably coupled to the first handle bar (91) via the first connecting rod (5*a*) and the second connecting rod (5*b*), wherein a distance between the lateral support rod (3) and a h plurality of hooks (4*a*, 4*b*) is configured to be adjusted to a predetermined distance, wherein the predetermined distance is determined according to a size of the external frame structure (8);

a first pipe body (7*a*) detachably coupled to the first through hole (51*a*) of the first connecting rod (5*a*);

a second pipe body (7*b*) detachably coupled to the second through hole (51*b*) of the second connecting rod (5*b*);

a first rod body (6*a*) slidably coupled to the first pipe body (7*a*);

a second rod body (6*b*) slidably coupled to the second pipe body (7*b*);

first locking components (1*a*, 1*b*) detachably coupling the first pipe body (7*a*) and the second pipe body (7*b*) to the first connecting rod (5*a*) and the second connecting rod (5*b*) respectively;

second locking components (2*a*, 2*b*) slidably coupling the first rod body (6*a*) and the second rod body (6*b*) to the first pipe body (7*a*) and the second pipe body (7*b*) respectively; and second handle bars (92*a*, 92*b*) extending transversely with respect to the first handle bar (91), wherein each of the second handle bars (92*a*, 92*b*) is respectively coupled to the first rod body (6*a*), and the second rod body (6*b*).

2. The horizontal fitness bar apparatus (100) of claim 1, wherein the plurality of hooks (4*a*, 4*b*) are respectively coupled to the first pipe body (7*a*) and the second pipe body (7*b*) for hanging the horizontal fitness bar apparatus (100) on a top beam (81) of the external frame structure (8).

3. The horizontal fitness bar apparatus (100) of claim 1, wherein each first locking component of the first locking components (1*a*, 1*b*) comprises:

a connector (11), wherein the connector (11) comprises a screw section (111) having external threads to be screwed into first connecting holes (52*a*, 52*b*) arranged on the first connecting rod (5*a*) and the second connecting rod (5*b*), the first connecting holes (52*a*, 52*b*) are formed on side surfaces (24*a*, 24*b*) of the first connecting rod (5*a*) and the second connecting rod (5*b*), a sliding groove (112) is defined in the connector (11), a bolt (12) slidably arranged on the connector (11), an elastic member (13) arranged along the bolt (12), wherein the elastic member (13) forces the bolt (12) to be inserted in the first connecting rod (5*a*) and the second connecting rod (5*b*), the elastic member (13) is arranged in the sliding groove (112) along the bolt (12), and a button (14) disposed over the connector (11).

4. The horizontal fitness bar apparatus (100) of claim 1, wherein each of the first rod body (6*a*) and the second rod body (6*b*) comprises:

a plurality of pinholes (61*a*, 61*b*), wherein the second locking components (2*a*, 2*b*) pass through the respective plurality of pinholes (61*a*, 61*b*) to lock the first pipe body (7*a*) to the first rod body (6*a*), and to lock the second pipe body (7*b*) to the second rod body (6*a*), respectively, to adjust a height of the second handle bars (92*a*, 92*b*).

5. The horizontal fitness bar apparatus (100) of claim 1, wherein the plurality of hooks (4*a*, 4*b*) comprises a L-shaped cross-section.

6. A horizontal fitness bar apparatus (100) comprising:

a first handle bar (91) extending laterally;

a first connecting rod (5*a*) having a first through hole (51*a*), wherein the first through hole (51*a*) extends from a top surface (20*a*) to a bottom surface (22*a*) of the first connecting rod (5*a*); and a second connecting rod (5*b*) having a second through hole (51*b*), wherein the second through hole (51*b*) extends from a top surface (20*b*) to a bottom surface (22*b*) of the second connecting rod (5*b*);

a lateral support rod (3) attached against an external frame structure (8), the lateral support rod (3) is detachably coupled to the first handle bar (91) via the first connecting rod (5*a*) and the second connecting rod (5*b*), wherein a distance between the lateral support rod (3) and a plurality of hooks (4*a*, 4*b*) is configured to be adjusted to a predetermined distance, wherein the predetermined distance is determined according to a size of the external frame structure (8);

a first pipe body (7*a*) detachably coupled to the first through hole (51*a*) of the first connecting rod (5*a*);

a second pipe body (7*b*) detachably coupled to the second through hole (51*b*) of the second connecting rod (5*b*);

a first rod body (6*a*) slidably coupled to the first pipe body (7*a*);

a second rod body (6*b*) slidably coupled to the second pipe body (7*b*);

first locking components (1*a*, 1*b*) detachably coupling the first pipe body (7*a*) and the second pipe body (7*b*) to the first connecting rod (5*a*) and the second connecting rod (5*b*) respectively;

second locking components (2*a*, 2*b*) slidably coupling the first rod body (6*a*) and the second rod body (6*b*) to the first pipe body (7*a*) and the second pipe body (7*b*) respectively; and second handle bars (92*a*, 92*b*) extending transversely with respect to the first handle bar (91), wherein each of the second handle bars (92*a*, 92*b*) are respectively coupled to the first rod body (6*a*) and the second rod body (6*b*); and wherein each of the first rod body (6*a*) and the second rod body (6*b*) comprise a plurality of pinholes (61*a*, 61*b*), wherein the second locking components (2*a*, 2*b*) passes through the respective plurality of pinholes (61*a*, 61*b*) to lock the first pipe body (7*a*) to the first rod body (6*a*) and the second pipe body (7*b*) to the second rod body (6*b*) respectively, to adjust a height of the second handle bars (92*a*, 92*b*) as per a user requirement.

7. The horizontal fitness bar apparatus (100) of claim 6, wherein the plurality of hooks (4*a*, 4*b*) are respectively coupled to the first pipe body (7*a*) and the second pipe body (7*b*) for hanging the horizontal fitness bar apparatus (100) on a top beam (81) of the external frame structure (8).

* * * * *